US010474074B2

(12) United States Patent
Shinji et al.

(10) Patent No.: US 10,474,074 B2
(45) Date of Patent: Nov. 12, 2019

(54) FILM FOR USE IN FIXING DEVICE AND FIXING DEVICE WITH FILM

(71) Applicant: CANON KABUSHIKI KAISHA, Tokyo (JP)

(72) Inventors: Takeshi Shinji, Yokohama (JP); Takashi Narahara, Mishima (JP); Kazuhiro Doda, Yokohama (JP); Yutaka Sato, Komae (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/238,790

(22) Filed: Jan. 3, 2019

(65) Prior Publication Data

US 2019/0137915 A1 May 9, 2019

Related U.S. Application Data

(63) Continuation of application No. 15/496,417, filed on Apr. 25, 2017, now Pat. No. 10,209,655.

(30) Foreign Application Priority Data

Apr. 28, 2016 (JP) ..... 2016-091445
Feb. 20, 2017 (JP) ..... 2017-029504

(51) Int. Cl.
*G03G 15/20* (2006.01)

(52) U.S. Cl.
CPC . *G03G 15/2057* (2013.01); *G03G 2215/2035* (2013.01)

(58) Field of Classification Search
CPC ..... G03G 15/2042; G03G 15/206
USPC ..... 399/333
See application file for complete search history.

(56) References Cited

U.S. PATENT DOCUMENTS

2011/0033215 A1* 2/2011 Yokoyama ..... G03G 15/2042 399/328
2014/0348559 A1* 11/2014 Miyahara ..... G03G 15/2057 399/333

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

A film for use in a fixing device includes a base layer having a cylindrical shape. An electrode portion is formed at an end part of the base layer in a longitudinal direction of the film. A heat generation portion is formed at a central part of the base layer in the longitudinal direction of the film and electrically connected to the electrode portion. The heat generation portion is formed of a conductive layer made of a same material as a material of the electrode portion. A thickness of the conductive layer is larger in the electrode portion than in the heat generation portion. A surface area of the conductive layer per unit length in the longitudinal direction of the film is larger in the electrode portion than in the heat generation portion.

17 Claims, 17 Drawing Sheets

FILM FOR USE IN FIXING DEVICE AND FIXING DEVICE WITH FILM

CROSS REFERENCE TO RELATED APPLICATIONS

The present application is a continuation of U.S. patent application Ser. No. 15/496,417, filed Apr. 25, 2017, entitled "FILM FOR USE IN FIXING DEVICE AND FIXING DEVICE WITH FILM", the content of which is expressly incorporated by reference herein in its entirety. Further, the present application claims priority from Japanese Patent Application No. 2016-091445, filed Apr. 28, 2016, and Japanese Patent Application No. 2017-029504, filed Feb. 20, 2017, both of which are also hereby incorporated by reference herein in their entirety.

BACKGROUND OF THE INVENTION

Field of the Invention

The disclosure relates to a film for use in a fixing device included in an image forming apparatus such as a copier and a printer, and to a fixing device with this film.

Description of the Related Art

A fixing device included in a copier or a printer uses a film. One known type of such a film has electrode portions and a heat generation portion (Japanese Patent Application Laid-Open No. 2011-253141). In this film, the electrode portions are formed at both end parts in a longitudinal direction of the film, and the heat generation portion is provided between the electrode portions. A fixing device using this film causes the film to generate heat, utilizing joule heat. The fixing device causes generation of the Joule heat, by feeding an electric current to the heat generation portion by bringing an electrode member such as a conductive brush into contact with the electrode portion. Since the film itself generates heat, the film can contribute to energy saving and a reduction in warm-up period of the fixing device.

SUMMARY OF THE INVENTION

According to an aspect of the disclosure, a film for use in a fixing device includes a base layer having a cylindrical shape, an electrode portion formed at an end part of the base layer in a longitudinal direction of the film, and a heat generation portion formed at a middle part of the base layer in the longitudinal direction of the film and electrically connected to the electrode portion, the heat generation portion being formed of a conductive layer made of a same material as a material of the electrode portion, wherein a thickness of the conductive layer is larger in the electrode portion than in the heat generation portion, and a surface area of the conductive layer per unit length in the longitudinal direction of the film is larger in the electrode portion than in the heat generation portion.

According to another aspect of the disclosure, a fixing device for fixing a toner image onto a recording material includes a film having a cylindrical shape, the film having a base layer, an electrode portion formed at an end part of the base layer in a longitudinal direction of the film, and a heat generation portion formed at a middle part of the base layer in the longitudinal direction of the film and electrically connected to the electrode portion, and the heat generation portion being formed of a conductive layer made of a same material as a material of the electrode portion, and a power supply member being in contact with the electrode portion, and configured to supply power to the heat generation portion via the electrode portion, wherein the toner image is fixed onto the recording material by heat of the film, and wherein a thickness of the conductive layer is larger in the electrode portion than in the heat generation portion, and a surface area of the conductive layer per unit length in the longitudinal direction of the film is larger in the electrode portion than in the heat generation portion.

According to yet another aspect of the disclosure, a method for manufacturing a film having a cylindrical shape and to be used in a fixing device, the film including a base layer having a cylindrical shape, and a conductive pattern formed on the base layer, includes performing first printing for printing the conductive pattern at an end part and a central part of the base layer in a longitudinal direction of the film to extend in a circumferential direction of the film, and performing second printing for printing the conductive pattern on the conductive pattern formed in the first printing only at the end part to extend in the circumferential direction of the film.

Further features and aspects of the disclosure will become apparent from the following description of numerous example embodiments with reference to the attached drawings.

DESCRIPTION OF THE EMBODIMENTS

Numerous example embodiments and various aspects of the disclosure will be described in detail below.

Figure 1:
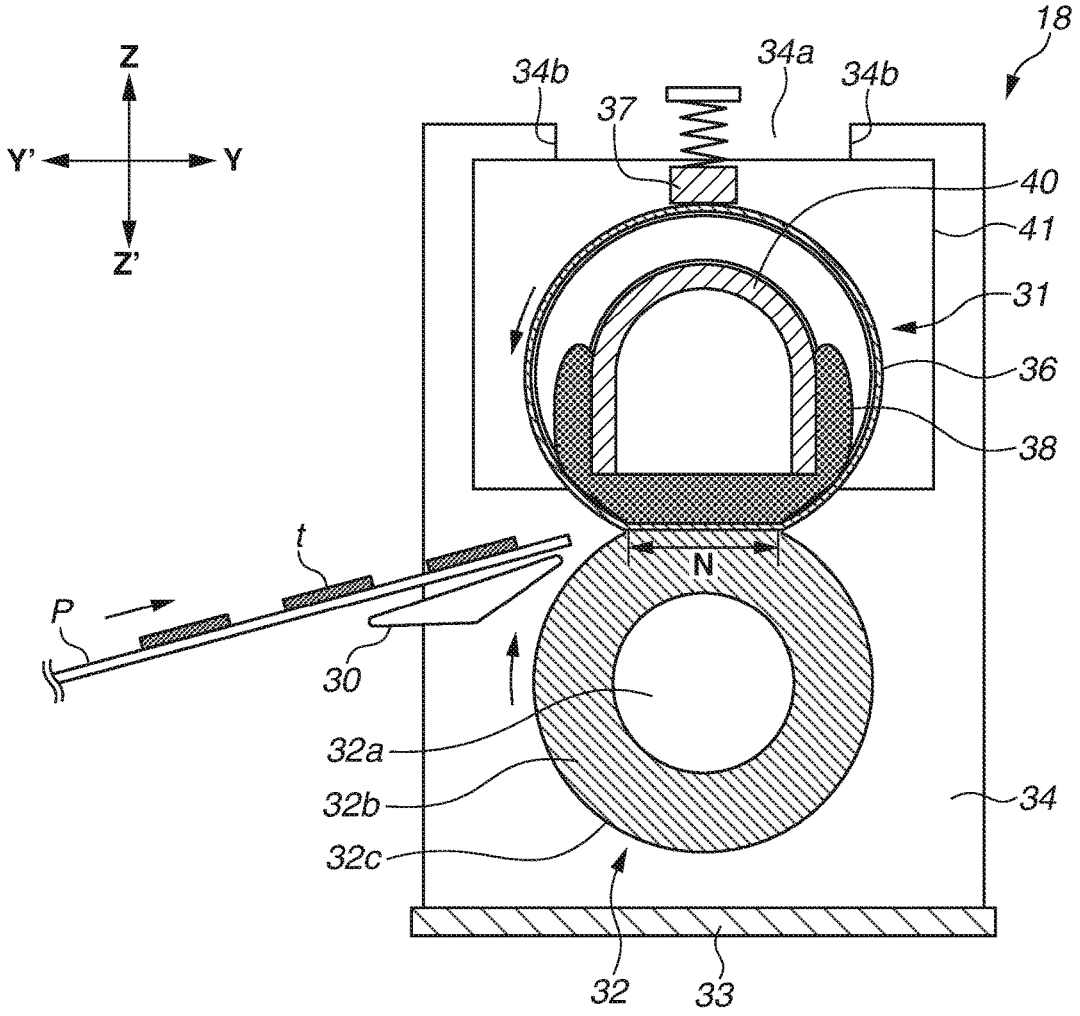
FIG. 1 is a sectional schematic diagram of a fixing device according to a first example embodiment.
Figure 2:
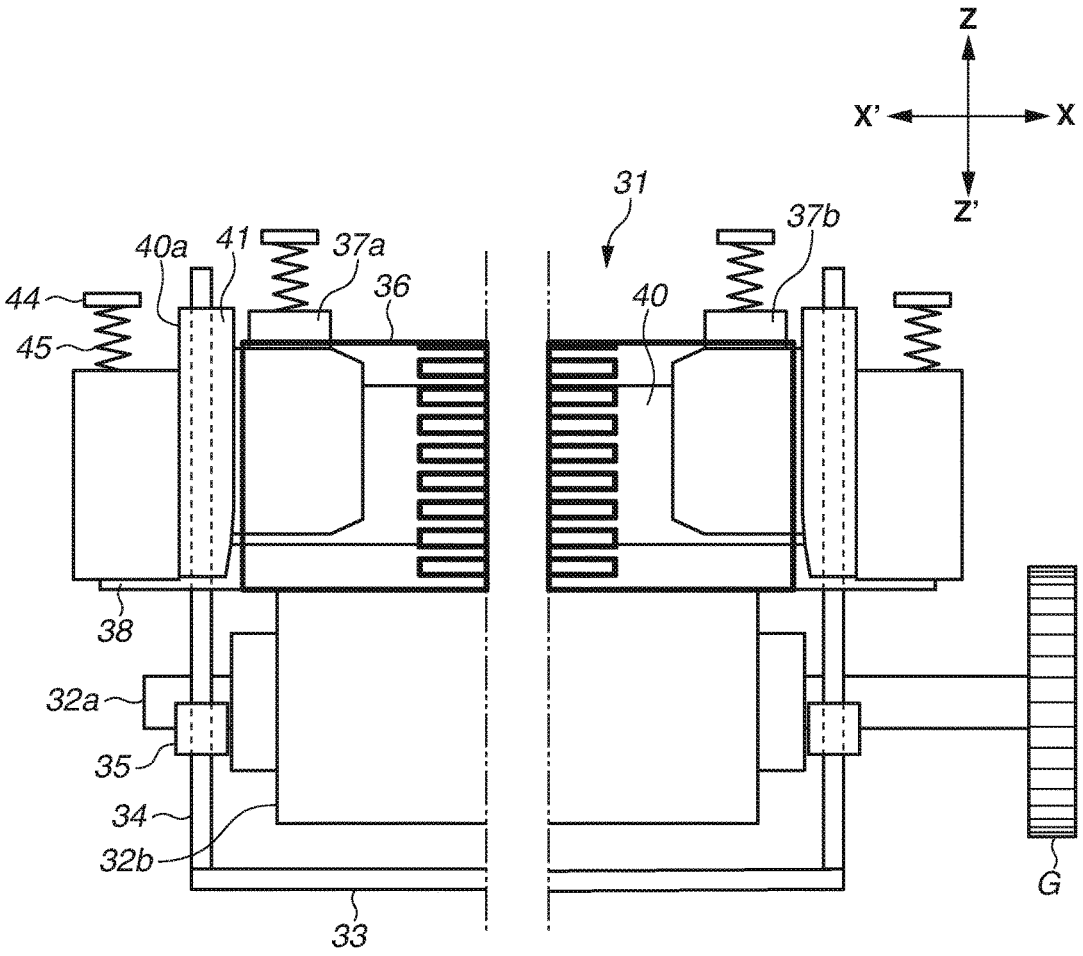
FIG. 2 is a front schematic diagram of the fixing device according to the first example embodiment.

A first example embodiment will be described with reference to FIGS. 1 to 7, and 15. FIG. 1 is a sectional schematic diagram of a fixing device 18. FIG. 2 is a front schematic diagram of the fixing device 18. In following description, a longitudinal direction is an X-axis direction, a width direction is a Y-axis direction, and a height direction is a Z-axis direction, as illustrated in the figures. The Y-axis direction is a conveyance direction for conveying a recording material. The fixing device 18 is of a resistance heating type. The fixing device 18 causes resistance heating (Joule heating) by feeding a direct electric current to a conductive layer of a film 36. The fixing device 18 of this type has such a feature of causing the film 36 itself to generate heat and thus can start up with higher heat efficiency and more rapidly than a device that heats the film 36 with a halogen heater and the like.

The fixing device 18 includes a film assembly 31 and a pressure roller 32. The film assembly 31 includes the film 36. The pressure roller 32 and the film assembly 31 are vertically aligned between side plates 34 on right and left, and disposed substantially parallel to each other. The side plates 34 on right and left are fixed to a device frame 33.

Figure 3:
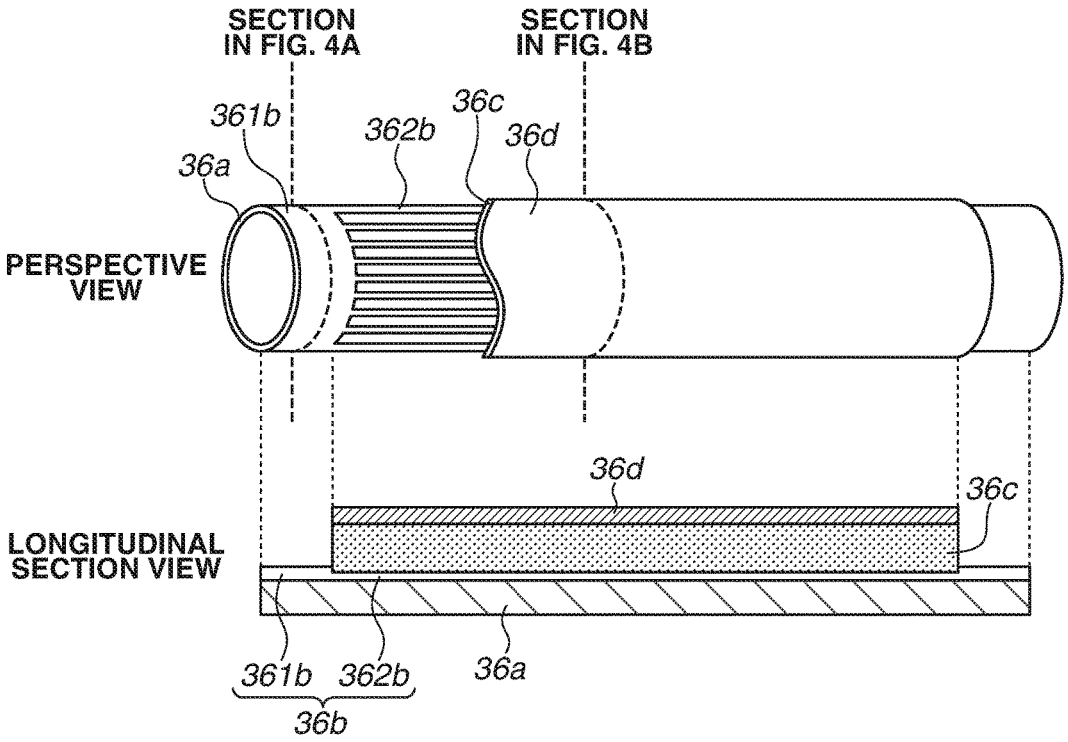
FIG. 3 illustrates a perspective view and a longitudinal section view of a film according to the first example embodiment.
Figure 4A:
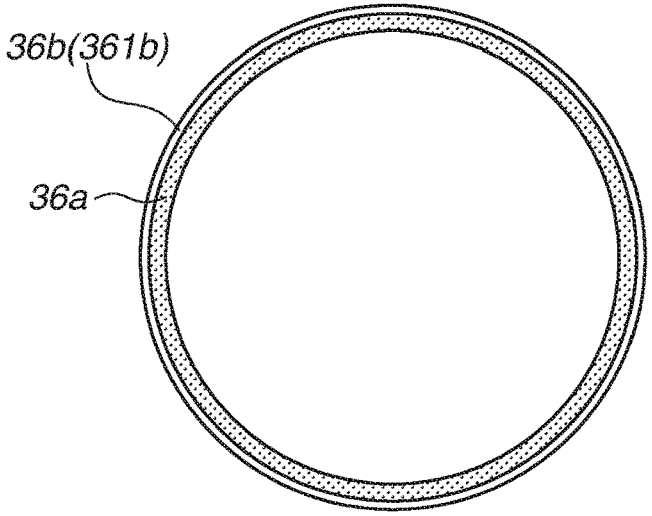
FIGS. 4A and 4B each illustrate a circumferential section view of a layer structure of the film according to the first example embodiment.
Figure 4B:
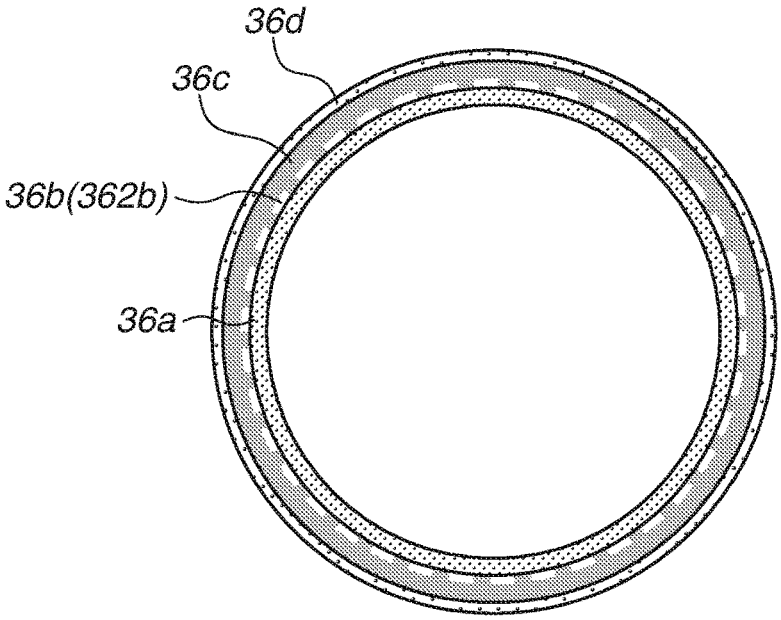

FIG. 3 illustrates a perspective view and a longitudinal section view of a configuration of the film 36. The film 36 includes a base layer 36*a* and a conductive layer 36*b* disposed on the base layer 36*a*. The film 36 further includes an elastic layer 36*c* and a release layer 36*d* disposed on the conductive layer 36*b*. The film 36 has flexibility. The elastic layer 36*c* and the release layer 36*d* are partially omitted in the perspective view, for easy understanding of a configuration of the conductive layer 36*b*. FIG. 4A illustrates a section view of an end part of the film 36, and FIG. 4B illustrates a section view of a central part of the film 36, in the longitudinal direction. For easy understanding of a layer structure of the film 36, the width and the interval of the conductive layer 36*b* as well as the proportion of the thickness of each layer are different from those in an actual case.

In the present example embodiment, a polyimide base is used as the base layer 36*a*. The polyimide base is formed to have a cylindrical shape and a thickness of approximately 60 μm. On the base layer 36*a*, the conductive layer 36*b* is formed to extend in the longitudinal direction. The conductive layer 36*b* is divided into an electrode portion 361*b* and a heat generation portion 362*b* in the longitudinal direction. The conductive layer 36*b* has a thickness of 20 μm in the electrode portion 361*b*, and a thickness of 10 μm in the heat generation portion 362*b*, for the reason to be described below. The electrode portion 361*b* is formed in a region having a width of approximately 10 mm at each of both end parts of the film 36 in the longitudinal direction. The electrode portion 361*b* is formed in the ring-shaped conductive layer 36*b*. The circular part is formed to extend in a circumferential direction of the film 36. The heat generation portions 362*b* are formed in a region between the electrode portions 361*b* formed at both end parts of the film 36. The heat generation portion 362*b* is formed of a plurality of thin linear parts of the conductive layer 36*b*. The plurality of thin linear parts extends in the longitudinal direction of the film 36 and are arranged at intervals in a rotation direction of the film 36. The thin linear parts of the conductive layer 36*b* are substantially parallel with each other. These parts each have a width of approximately 0.5 mm, and the interval between these parts is approximately 1.5 mm. In the heat generation portion 362*b*, a surface area per unit length in the longitudinal direction of the film 36 is smaller than that in the electrode portion 361*b*. Therefore, the heat generation portion 362*b* has a higher resistance and a greater heat generation amount than those of the electrode portion 361*b*. Examples of a method for forming the conductive layer 36*b* on the base layer 36*a* include printing, plating, sputtering, and vapor deposition. In the present example embodiment, the conductive layer 36*b* is formed by screen printing of silver ink.

On the conductive layer 36*b*, the elastic layer 36*c* made of a material such as silicone rubber and fluororubber is formed. The elastic layer 36*c* has a thickness of approximately 200 μm. On the elastic layer 36*c*, the release layer 36*d* is formed as a coating to be the uppermost surface layer. The release layer 36*d* is a perfluoroalkoxy (PFA) resin tube and has a thickness of approximately 15 μm. In the present example embodiment, a film having an inner diameter of approximately 18 mm is used as the film 36. The elastic layer 36*c* and the release layer 36*d* are provided to cover only the heat generation portion 362*b*, not provided on the electrode portion 361*b*.

The pressure roller 32 has a metal core 32*a*, an elastic layer 32*b*, and a release layer 32*c*. The elastic layer 32*b* is formed on the outer side of the metal core 32*a*. The release layer 32*c* is formed on the outer side of the elastic layer 32*b*. The metal core 32*a* is formed of metal such as stainless steel. The elastic layer 32*b* is formed of rubber such as silicone rubber and fluororubber. The release layer 32*c* is formed of fluororesin such as PFA, polytetrafluoroethylene (PTFE), and fluorinated ethylene propylene (FEP). In the pressure roller 32 used in the present example embodiment, the metal core 32*a* is made of stainless steel and has an outer diameter of 11 mm. Further, the elastic layer 32*b* is formed on the metal core 32*a* by injection molding. The elastic layer 32*b* is a silicone rubber layer and has a thickness of approximately 3.5 mm. Furthermore, the release layer 32*c* is formed on the elastic layer 32*b*. The release layer 32*c* is a PFA coating layer, and has a thickness of approximately 40 μm. The pressure roller 32 has an outer diameter of approximately 18 mm. In view of securing a fixing nip N and having endurance, the pressure roller 32 can have hardness in a range of 40 degrees to 70 degrees in weighting of 9.8 N measured with a ASKER-C durometer. In the present example embodiment, the hardness is 54 degrees. As illustrated in FIG. 2, the pressure roller is held at both ends of the metal core 32*a* in the longitudinal direction. The pressure roller 32 is rotatably supported between the side plates 34 of the device frame 33 via bearing members 35. A drive gear G is fixed to one end part of the metal core 32*a*. The pressure roller 32 is rotated by a rotary force transmitted from a drive mechanism unit (not illustrated) to the drive gear G.

As illustrated in FIG. 1, the film assembly 31 has a holder 38, in addition to the film 36. The holder 38 guides the film 36 from inside. The holder 38 serves as a nip portion formation member that forms a nip portion with the pressure roller 32, with the film 36 interposed therebetween. The film assembly 31 further has a stay 40 and a flange 41. The stay 40 is provided to reinforce the holder 38. The flange 41 is provided on each of right and left to serve as a restriction member that restricts movement of the film 36 in the longitudinal direction.

As illustrated in FIG. 1, the holder 38 is a member shaped like a bucket and having a substantially semicircular shape in a cross section. The holder 38 has rigidity, heat resistance, and thermal insulation. The holder 38 is formed of a liquid crystal polymer. The holder 38 also serves as a guide member that guides rotation of the film 36 fit onto the holder 38.

The stay 40 is a member having a U-shaped section and extending in the longitudinal direction of the film 36. The stay 40 is inserted into the holder 38, and the holder 38 is covered with the film 36. Further, the flanges 41 on right and left are engaged with right and left outwardly extending arms, respectively, of the stay 40. The film assembly 31 is thus assembled.

As illustrated in FIG. 1, the film assembly 31 is disposed between the side plates 34 on right and left, with the holder 38 side facing downward. The film assembly 31 is disposed on the pressure roller 32 to be substantially parallel with the pressure roller 32. Vertical groove portions of the respective flanges 41 on right and left are engaged with vertical edge portions of the respective side plates 34 on right and left. In the present example embodiment, a liquid crystal polymer resin is used as a material of the flange 41. The side plates 34 on right and left are fixed to the device frame 33, to form a housing of the fixing device 18.

Further, as illustrated in FIG. 2, a pressurizing spring 45 is provided in a shrunk state between a pressure arm 44 and a pressure portion of each of the flanges 41 on right and left. This pressurizes the flanges 41 on right and left, the stay 40, and the holder 38 with a predetermined pressing force, toward a lower surface of the pressure roller 32, via the film 36. In the present example embodiment, the pressurizing spring 45 is set to have such a pressure that the film 36 and the pressure roller 32 have a total pressure of 160 N. This pressurization brings the holder 38 into pressure contact with an upper surface of the pressure roller 32 with the film 36 interposed therebetween, so that a fixing nip portion N of about 6 mm is formed.

When a driving force is transmitted from a driving source (not illustrated) to the drive gear G of the pressure roller 32, the pressure roller 32 is driven to rotate in a counterclockwise direction in FIG. 1, at a predetermined speed. Following this rotation of the pressure roller 32, a rotary force is exerted on the film 36 by a frictional force between the pressure roller 32 and the film 36 at the fixing nip portion N. The film 36 is thereby rotated around the holder 38 in a clockwise direction in FIG. 1, while the inner surface of the film 36 slides on the holder 38.

After the film 36 is rotated by the rotation of the pressure roller 32, power is supplied to the conductive layer 36*b* to increase the temperature of the film 36. After the temperature of the film 36 reaches a predetermined temperature, a recording material P is introduced into the fixing nip portion N. An entry guide 30 has a role in guiding the recording material P, on which an unfixed toner image t is formed, toward the fixing nip portion N.

The unfixed toner image t is fixed onto the recording material P at the fixing nip portion N, when the recording material P carrying the unfixed toner image t is heated while being conveyed. The fixing nip portion N is formed by the film 36 and the pressure roller 32.

A power feeding member (power supply member) 37 is provided to supply power from a power supply 50 to the conductive layer 36*b*. The power feeding member 37 is formed of a conductive material such as metal and carbon. As illustrated in FIGS. 1 and 2, the power feeding member 37 is urged by an urging member such as a spring, from an outer surface of the film 36, toward the electrode portion 361*b* provided at each of both end parts of the film 36.

Figure 5:
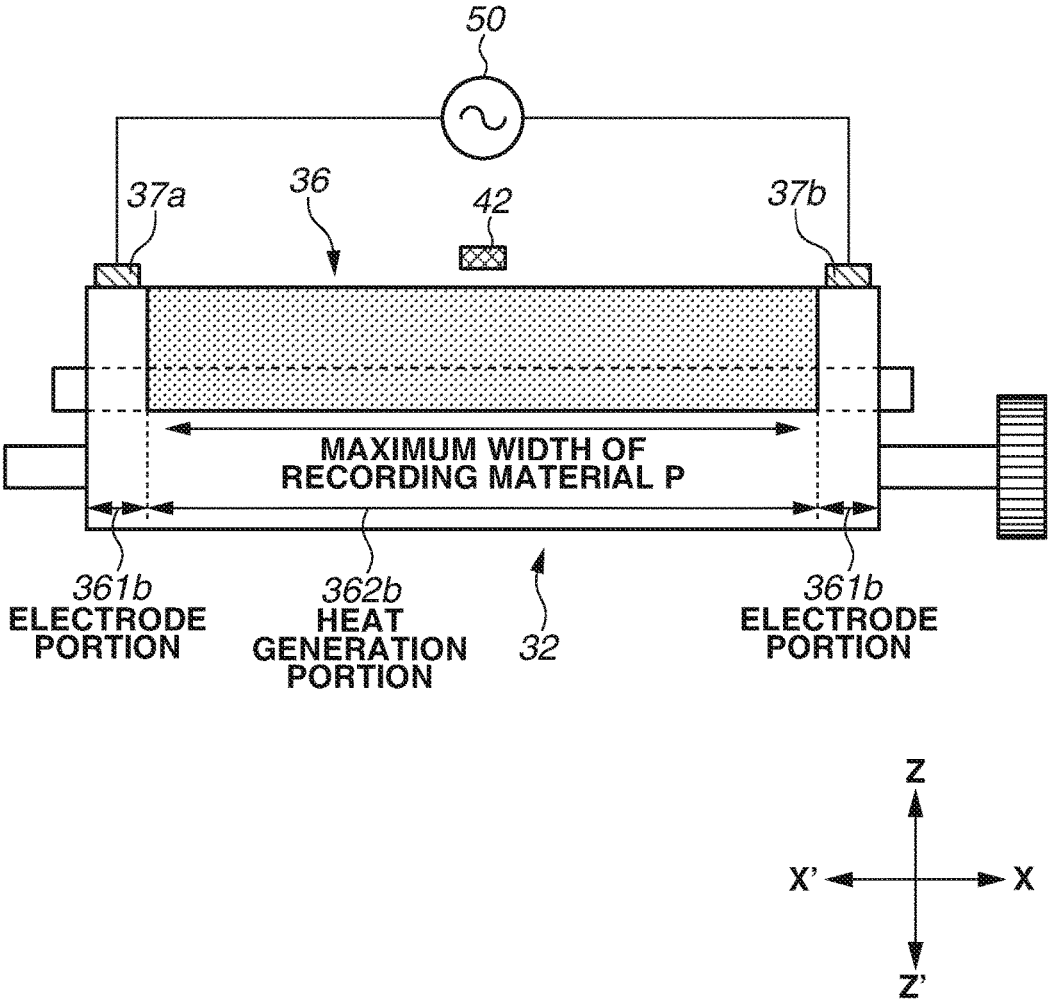
FIG. 5 is a schematic diagram illustrating electrical connection according to the first example embodiment.

FIG. 5 is a schematic diagram illustrating electrical connection of the fixing device 18. The power feeding member 37 is formed of power feeding members 37*a* and 37*b* provided at both end parts of the film 36. The power feeding members 37*a* and 37*b* are each connected to the power supply 50 with a conducting wire. The power supply 50 is controlled by a controller (not illustrated) to supply power.

An electric current flows through the conductive layer 36*b* by supply of power from the power feeding members 37*a* and 37*b* to the conductive layer 36*b*. This causes generation of Joule heat that quickly increases the temperature of the film 36. A temperature detection unit 42 measures a surface temperature of the film 36 in a noncontact manner. In the present example embodiment, a thermopile is used. The temperature detection unit 42 is disposed at a substantially middle part of the film 36 in the longitudinal direction. The temperature detection unit 42 detects the surface temperature of the film 36. The controller controls the power to be supplied to the film 36 in such a manner that the temperature detected by the temperature detection unit 42 is maintained at a target temperature.

The heat generation portion 362*b* is provided to have a greater length in the longitudinal direction than a maximum width of the recording material P. This suppresses unnecessary heat generation in the electrode portion 361*b*, through which the recording material P does not pass, while applying sufficient heat to the entire recording material P.

In the present example embodiment, the electrode portion 361*b* and the heat generation portion 362*b* are integrally formed as the conductive layer 36*b* by printing the same material of the silver ink. The electrode portion 361*b* of the conductive layer 36*b* is formed on the entire circumference of the film 36 in the circumferential direction of the film 36. In contrast, the heat generation portion 362*b* of the conductive layer 36*b* is formed to be thin lines each having the width of approximately 0.5 mm and arranged at the interval of approximately 1.5 mm.

Here, when the electrode portion 361*b* and the heat generation portion 362*b* are made of the same material, the electrode portion 361*b* also generates heat due to the Joule heat. When the thickness of the heat generation portion 362*b* and the thickness of the electrode portion 361*b* are the same, a resistance ratio per unit length in the longitudinal direction between the electrode portion 361*b* and the heat generation portion 362*b* is proportional to the surface area of the conductive layer 36*b* and thus is about 1:4. In other words, the electrode portion 361*b* is formed to have a greater surface area per unit length in the longitudinal direction of the film 36 than that of the heat generation portion 362*b*, so that the resistance value of the electrode portion 361*b* is reduced. Therefore, when the power is supplied to the conductive layer 36*b*, the heat is generated in proportion to the resistance ratio.

The heat generation in the electrode portion 361*b* is desirably as small as possible. This is because the heat generation in the electrode portion 361*b*, through which the recording material P does not pass, not only reduces energy efficiency, but also may damage neighboring members such as the film 36 and the power feeding member 37 due to heat accumulation. The heat accumulation occurs because the heat is not removed by the recording material P.

Hence, in the present example embodiment, the electrode portion 361*b* and the heat generation portion 362*b* are integrally formed to be the conductive layer 36*b* by using the same material, and the thickness of the conductive layer 36*b* in the electrode portion 361*b* is larger than the thickness of the conductive layer 36*b* in the heat generation portion 362*b*. Since the thickness of the conductive layer 36*b* in the electrode portion 361*b* is larger, it is possible to suppress a heat generation amount, by making the resistance value of the electrode portion 361*b* relatively low, while forming the electrode portion 361*b* and the heat generation portion 362*b* with the same material to be the conductive layer 36*b*.

In the present example embodiment, the electrode portion 361*b* is formed by performing printing twice, while the heat generation portion 362*b* is formed by performing printing once. In other words, the electrode portion 361*b* is printed on the electrode portion 361*b* formed in the first printing. The thickness of the electrode portion 361*b* is therefore approximately double the thickness of the heat generation portion 362*b*. Accordingly, the resistance value per unit area of the electrode portion 361*b* is about half, and the heat generation amount is about half as well in proportion to the resistance value.

In the present example embodiment, surface resistivity when the heat generation portion 362*b* is printed once is $7.04\times10^{-1}$ Ω/□, as a value measured by a method conforming to JIS K7194 by using a Loresta GP (manufactured by Mitsubishi Chemical Analytech Co., Ltd.). In contrast, surface resistivity when the heat generation portion 362*b* is printed twice is $3.61\times10^{-1}$ Ω/□, which is about half.

An appropriate value should be selected as the surface resistivity of the heat generation portion 362*b*, based on a width-spacing ratio of the conductive layer 36*b* shaped like thin lines, and a target value of the resistance value between both ends of the film 36. If a ratio of the conductive layer 36 shaped like thin lines to the base layer 36*a* in the circumferential direction of the film 36 is small in the heat generation portion 362*b*, an area of heat generation becomes small. Therefore, heat generation non-uniformity on the surface of the film 36 becomes large. In contrast, if the ratio of the conductive layer 36 shaped like thin lines to the base layer 36*a* in the circumferential direction of the film 36 is large, the heat generation non-uniformity is improved. However, the difference in resistance value between the electrode portion 361*b* and the heat generation portion 362*b* is reduced, which increases the heat generation amount of the electrode portion 361*b*. In the present example embodiment, the ratio of the length of the conductive layer 36*b* shaped like thin lines to the length of one round of the base layer 36*a* in the circumferential direction of the film 36 is ¼ in the heat generation portion 362*b*. In addition, the resistance value between both ends of the film 36 is designed to be 18Ω. Suppression of the heat generation non-uniformity on the surface of the film 36 and suppression of the heat generation of the electrode portion 361*b* can be compatible. Considering this compatibility, the ratio of the length of the conductive layer 36 shaped like thin lines to the length of one round of the base layer 36*a* in the circumferential direction of the film 36 is desirably 1/10 or more and ¾ or less in the heat generation portion 362*b*.

Figure 6A:
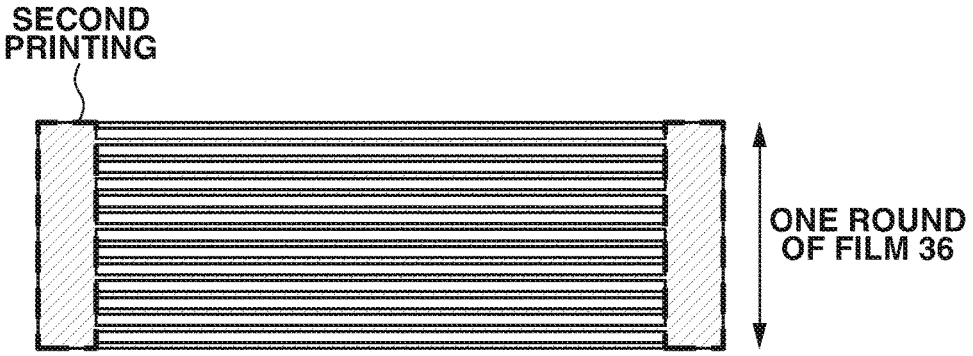
FIGS. 6A and 6B are diagrams each illustrating a print pattern example according to the first example embodiment.
Figure 6B:
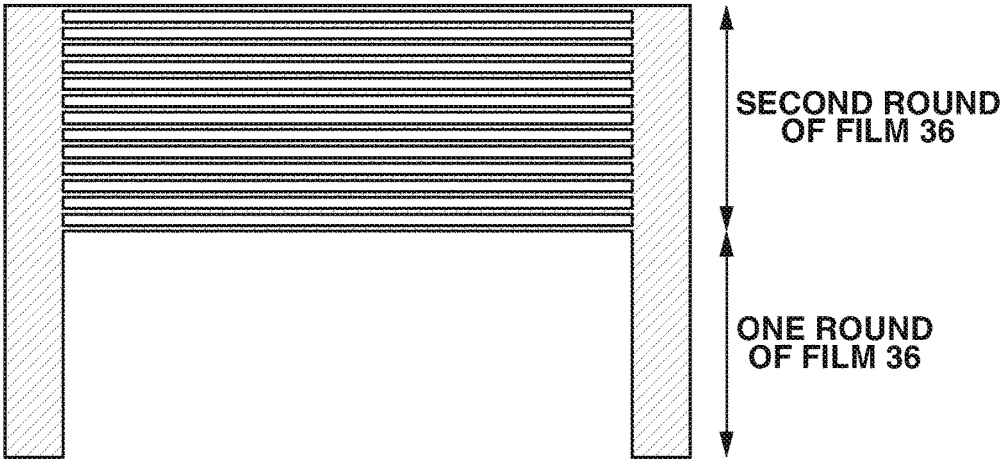

Examples of a method for printing the electrode portion 361*b* twice include the following two methods. One is a method for printing a pattern of the electrode portion 361*b* and the heat generation portion 362*b* in the first printing, and printing only the electrode portion 361*b* at each of both end parts of the film 36 in the longitudinal direction in the second printing, as illustrated in FIG. 6A. Another is a method for printing only the electrode portion 361*b* at each of both end parts of the film 36 in the longitudinal direction in the first printing, and printing the pattern of the electrode portion 361*b* and the heat generation portion 362*b* in the second printing, as illustrated in FIG. 6B. When the second printing is performed as illustrated in FIG. 6A, the electrode portion 361*b* formed in the second printing may overlay the electrode portion 361*b* formed in the first printing. Alternatively, the electrode portion 361*b* formed in the second printing may be broader or narrower than the electrode portion 361*b* formed in the first printing. If the electrode portion 361*b* formed in the second printing is broader than the electrode portion 361*b* formed in the first printing, the electrode portion 361*b* formed in the first printing can be reliably covered. If the electrode portion 361*b* formed in the second printing is narrower than the electrode portion 361*b* formed in the first printing, on the other hand, there is such an advantage that it is easy to control the position of the boundary between the electrode portion 361*b* and the heat generation portion 362*b*.

Figure 7:
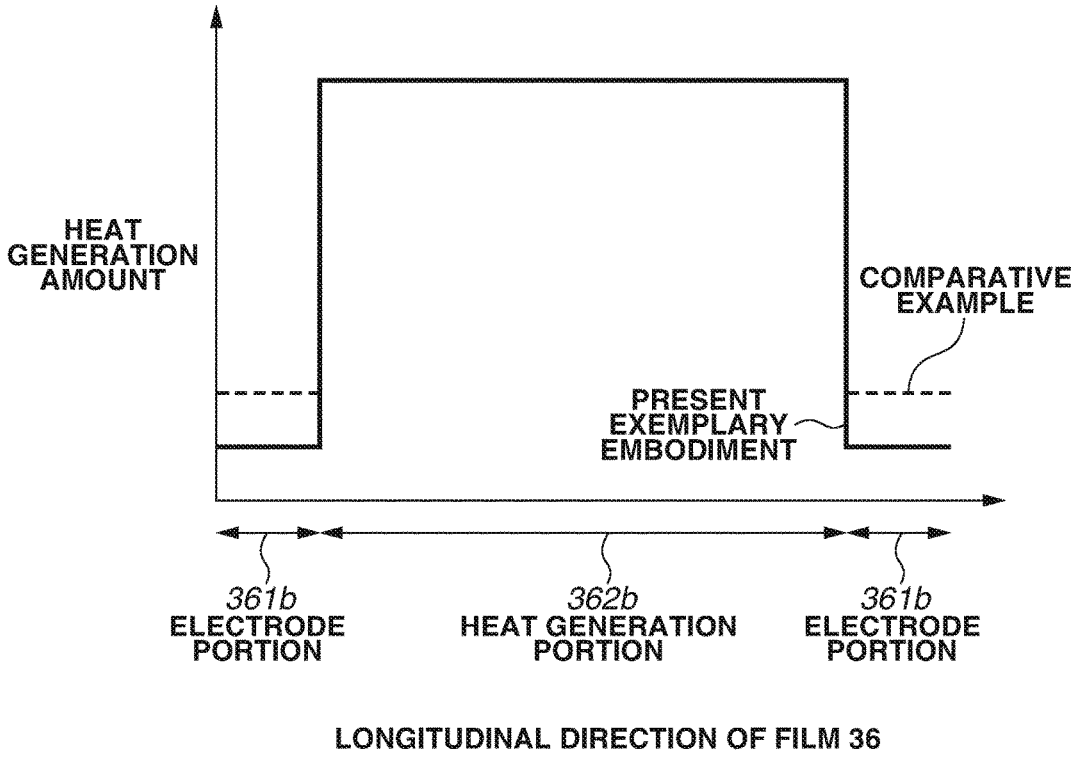
FIG. 7 is a diagram illustrating a heat generation amount of the film according to the first example embodiment.

FIG. 7 is a graph illustrating a comparison between the present example embodiment and a comparative example, in terms of the heat generation amount of the surface of the film 36 in the longitudinal direction. In the comparative example, the electrode portion 361*b* is formed by printing only once, and the thickness of the electrode portion 361*b* and the thickness of the heat generation portion 362*b* are the same. The heat generation amount in the electrode portion 361*b* to the heat generation amount in the heat generation portion 362*b* is about ¼ in the comparative example, but is about ⅛ in the present example embodiment. In the present example embodiment, the resistance of the electrode portion 361*b* is low, and thus the heat generation at both end parts can be suppressed, as compared with the comparative example.

As described above, according to the present example embodiment, the electrode portion 361*b* and the heat generation portion 362*b* are integrally formed of the same material, and the thickness of the electrode portion 361*b* is larger than the thickness of the heat generation portion 362*b*. Therefore, the heat generation of the electrode portion 361*b* can be suppressed.

The present example embodiment is described using the case where the thickness is approximately doubled by printing only the electrode portion 361*b* twice. However, the doubled thickness may be unattainable depending on a printing method. Even in such a case, an effect of reducing the heat generation amount in the electrode portion 361*b* is produced by an increase in the thickness.

Figure 8:
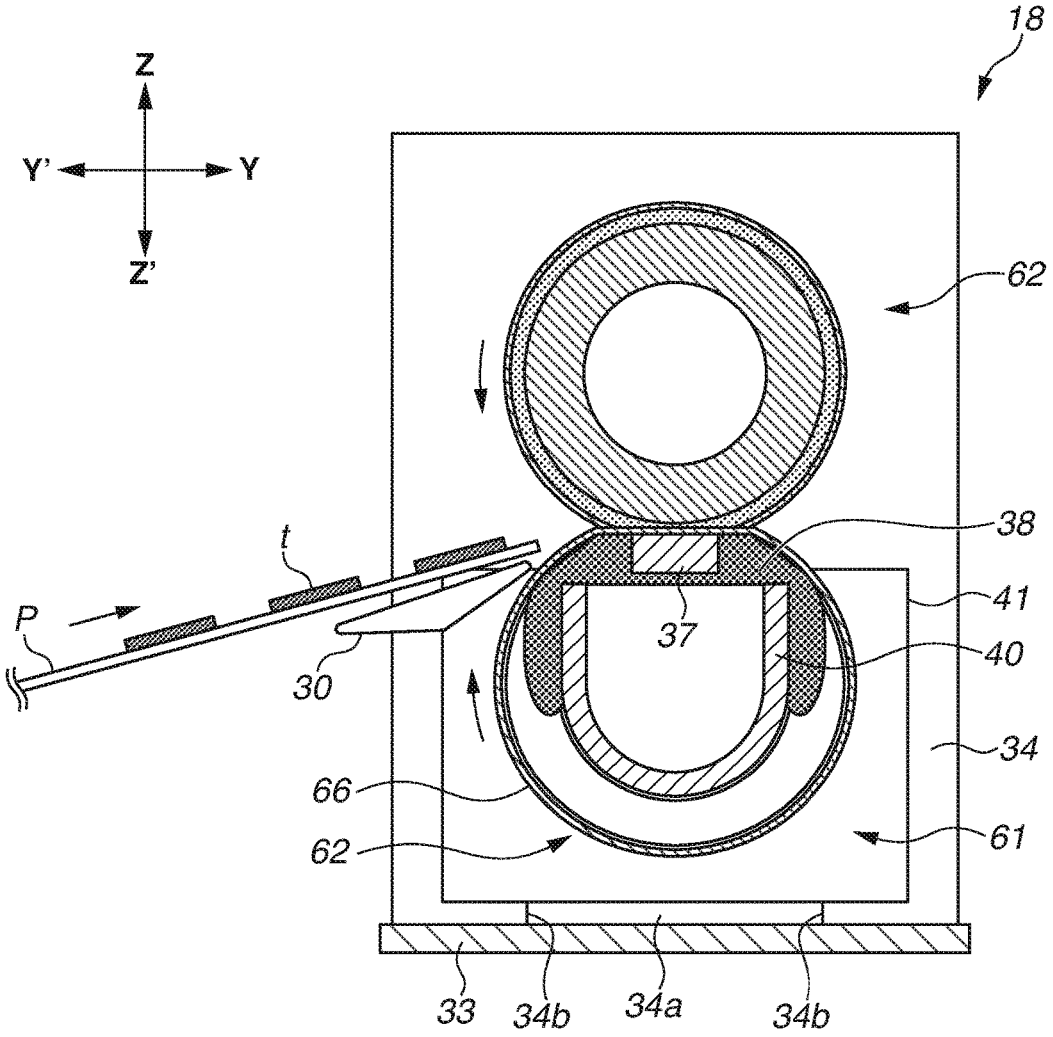
FIG. 8 is a sectional schematic diagram of a fixing device according to a second example embodiment.
Figure 9:
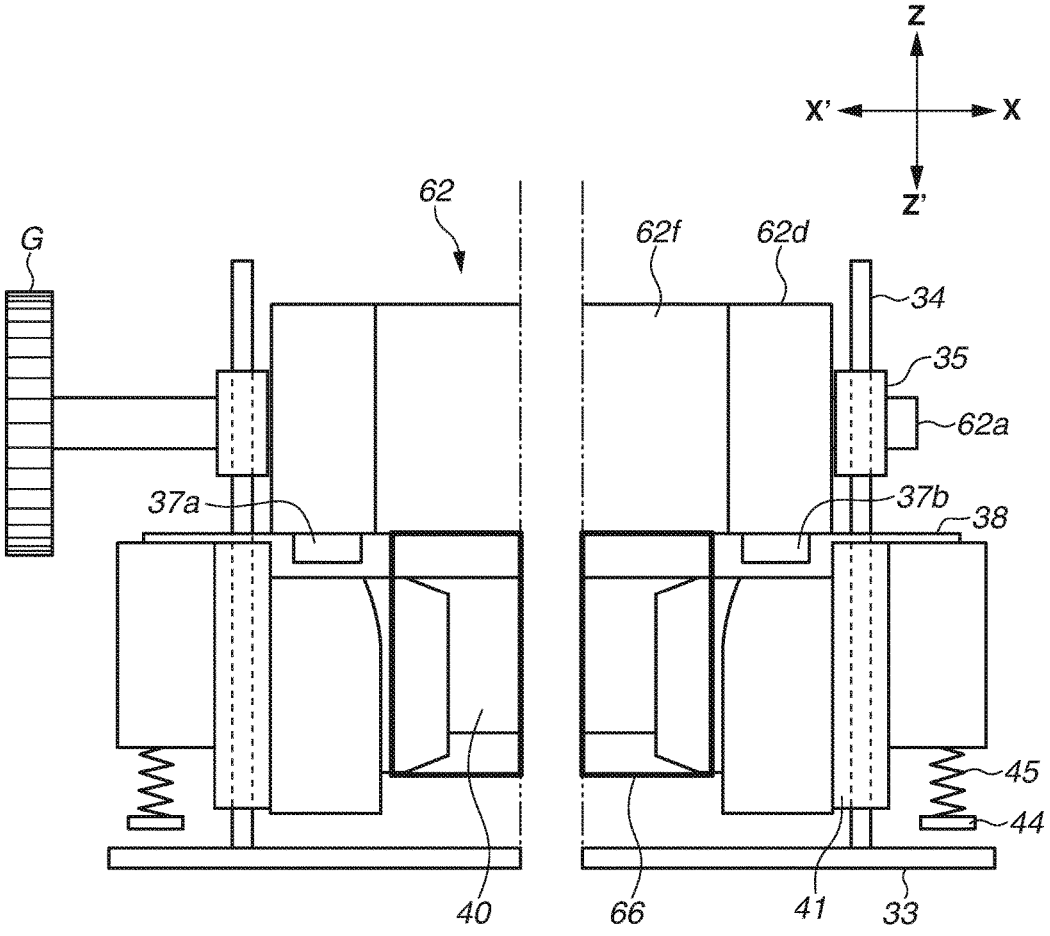
FIG. 9 is a front schematic diagram of the fixing device according to the second example embodiment.
Figure 10:
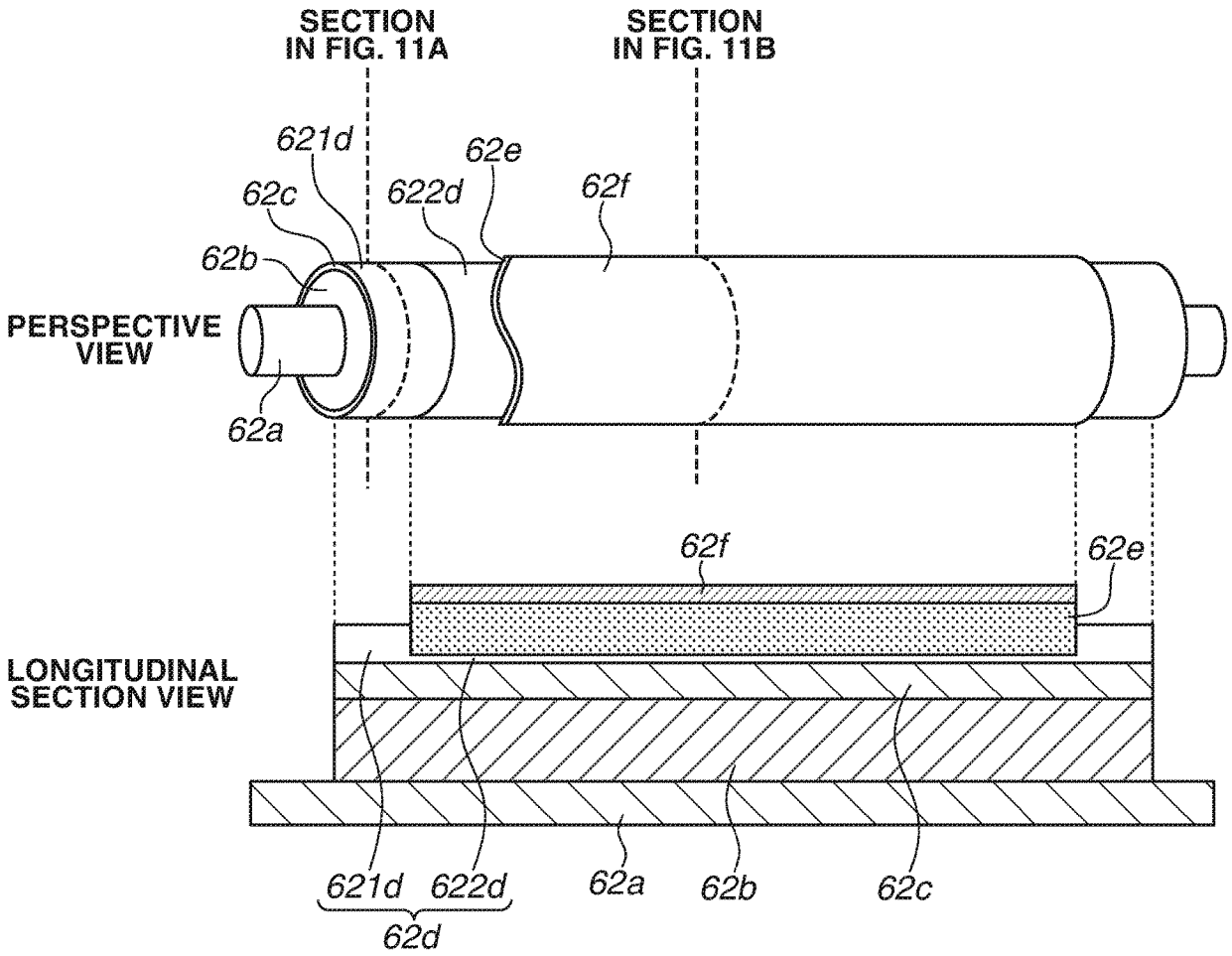
FIG. 10 illustrates a perspective view and a longitudinal section view of a fixing roller according to the second example embodiment.
Figure 11A:
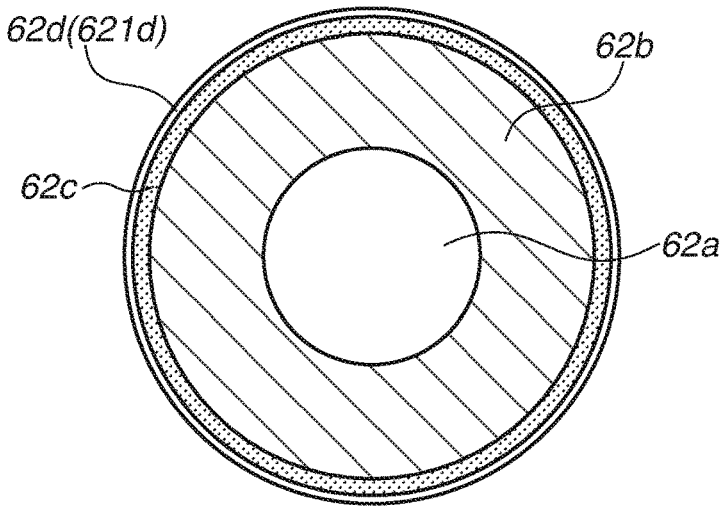
FIGS. 11A and 11B each illustrate a circumferential section view of a layer structure of a film according to the second example embodiment.
Figure 11B:
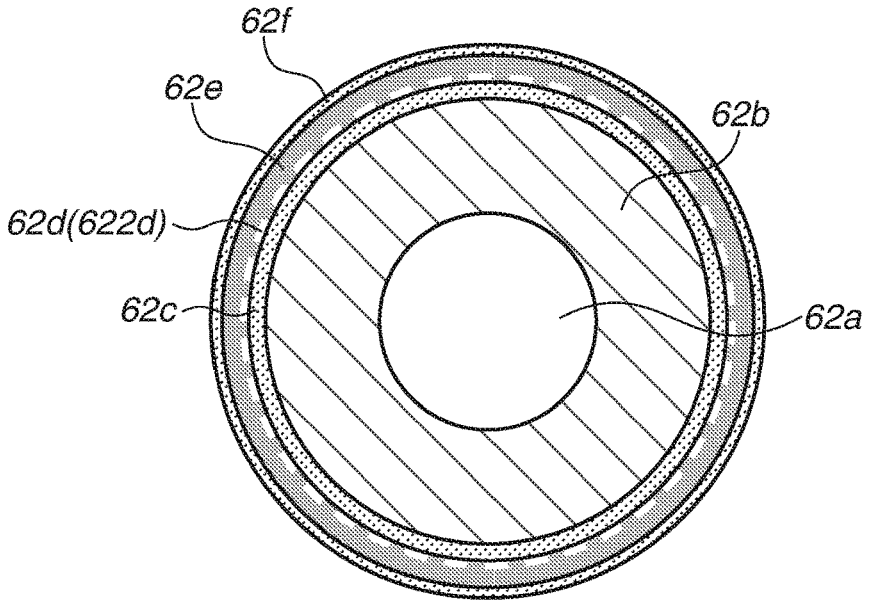
Figure 12:
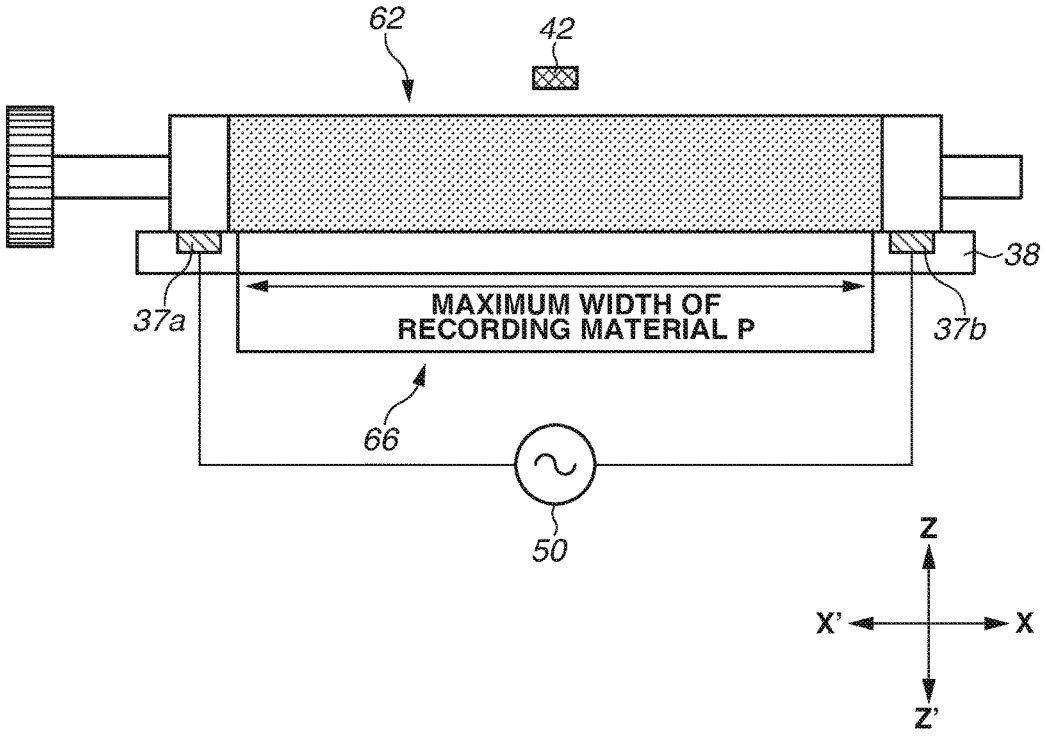
FIG. 12 is a schematic diagram illustrating electrical connection according to the second example embodiment.

A second example embodiment will be described with reference to FIGS. 8, 9, 10, 11A, 11B, 12, and 13. FIG. 8 is a sectional schematic diagram of a fixing device 18 in the present example embodiment. FIG. 9 is a front schematic diagram of the fixing device 18. FIG. 10 illustrates a perspective view of a fixing roller 62. FIGS. 11A and 11B each illustrate a section view of a layer structure of the fixing roller 62. FIG. 12 is a schematic diagram illustrating electrical connection.

The present example embodiment is different from the first example embodiment as follows. In present example embodiment, in place of the film 36, a conductive layer 62*d* provided in the fixing roller 62 is caused to generate heat. In addition, a heat generation portion 622*d* is formed on the entire circumference in a circumferential direction.

Operation and configuration similar to those of the first example embodiment may not be described, and only a point different from the above-described example embodiment will be described here.

In the present example embodiment, a nip portion is formed by the fixing roller 62 on upper side and a pressurizing film assembly 61 on lower side, as illustrated in FIGS. 8 and 9. A power feeding member 37 is provided in a holder 38, and disposed more outwardly than an end part of a pressurizing film 66. The power feeding member 37 feeds power to the fixing roller 62 from outside.

The fixing roller 62 includes a metal core 62*a*, a first elastic layer 62*b*, a resin layer 62*c*, the conductive layer 62*d*, a second elastic layer 62*e*, and a release layer 62*f*, which are laminated in this order.

FIG. 10 illustrates a perspective view illustrating a configuration of each of the metal core 62*a*, the first elastic layer 62*b*, the resin layer 62*c*, and the conductive layer 62*d* of the fixing roller 62. For easy understanding to the configuration of the conductive layer 62*d*, the second elastic layer 62*e* and the release layer 62*f* are partially omitted. FIGS. 11A and 11B each illustrate a section view of the layer structure of the fixing roller 62. FIG. 11A illustrates a section view of an end part, and FIG. 11B illustrates a section view of a middle part, of the fixing roller 62 in the longitudinal direction. The second elastic layer 62*e* and the release layer 62*f* are not formed at an electrode portion 621*d*, while being formed only at the heat generation portion 622*d*. For easy understanding of the configuration, the proportion of the thickness of each layer is different from that in an actual case.

In the present example embodiment, the metal core 62*a* is formed of stainless steel and has an outer diameter of 11 mm. On the metal core 62*a*, the first elastic layer 62*b* is formed by injection molding. The first elastic layer 62*b* is a silicone rubber layer and has a thickness of approximately 3.5 mm. The resin layer 62*c* is then formed on the first elastic layer 62*b* as a coating. The resin layer 62*c* is made of a polyimide (PI) film and has a thickness of approximately 60 μm. Further, the conductive layer 62*d* having a thickness of approximately 2 μm is formed on the resin layer 62*c*. Furthermore, the second elastic layer 62*e* is formed on the conductive layer 62*d*. The second elastic layer 62*e* is made of a material such as silicone rubber and fluororubber and has a thickness of approximately 200 μm. On the second elastic layer 62*e*, the release layer 62*f* is formed as the uppermost surface layer. The release layer 62*f* is a PFA coating layer and has a thickness of approximately 15 μm. The fixing roller 62 thus formed is used. The second elastic layer 62*e* plays a role in improving fixability by reducing hardness near the surface of the fixing roller 62. The fixing roller 62 has an outer diameter of approximately 18 mm.

As illustrated in FIGS. 9 and 12, in a region of approximately 10 mm at each of both end parts of the fixing roller 62 in the longitudinal direction, the second elastic layer 62*e* and the release layer 62*f* are not formed while the conductive layer 62*d* is exposed. The power feeding member 37 is in contact with the conductive layer 62*d* and thereby supplies power to the conductive layer 62*d*.

The pressurizing film 66 has a release layer formed on a base layer made of heat-resistant resin. The pressurizing film 66 has flexibility. In the present example embodiment, a polyimide base formed into a cylindrical shape and having a thickness of approximately 60 μm is used as the base layer. On the base layer, a coating of a PFA resin tube having a thickness of approximately 15 μm is formed as the release layer. In the present example embodiment, the pressurizing film 66 having an inner diameter of approximately 18 mm is used.

In the present example embodiment, the conductive layer 62*d* is formed on the entire circumference while covering the whole area in the longitudinal direction. The conductive layer 62*d* is formed by electroless nickel plating.

Therefore, when the thickness of the heat generation portion 622*d* and the thickness of the electrode portion 621*d* in the conductive layer 62*d* are the same, the electrode portion 621*d* also generates heat as much as the heat generated by the heat generation portion 622*d*.

Figure 13:
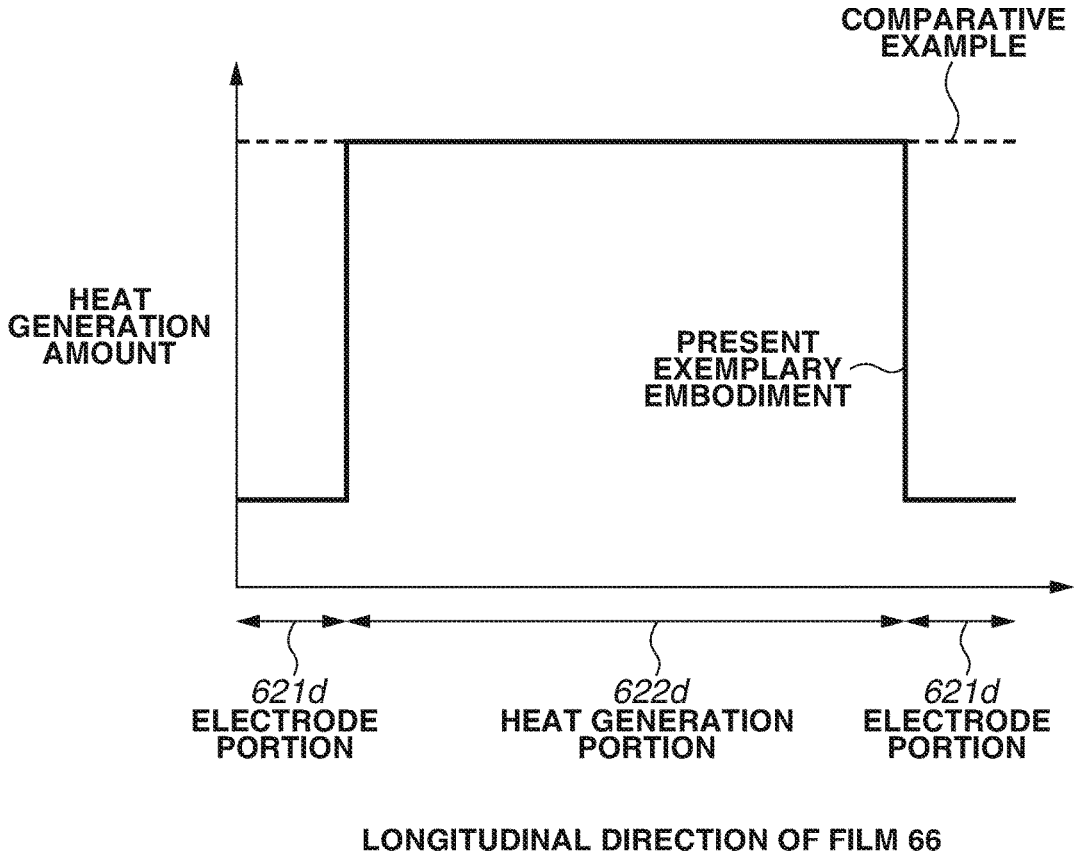
FIG. 13 is a diagram illustrating a heat generation amount of the fixing roller according to the second example embodiment.

Hence, in the present example embodiment, the thickness of the electrode portion 621*d* is approximately five times larger than the thickness of the heat generation portion 622*d*. As one method for increasing the thickness of the electrode portion 621*d*, a longer plating period is set only for the end part. The approximately five times larger thickness reduces the heat generation amount in the electrode portion 621*d* to approximately ⅕, as illustrated in FIG. 13. The heat generation can be thereby suppressed at the end part.

Further, in contrast to the first example embodiment, the present example embodiment has such an advantage that the film 66 is less likely to be damaged than the film 36 in the first example embodiment, because inner space formed by the conductive layer 62*c* is filled with the first elastic layer 62*b*.

As described above, in the present example embodiment, the electrode portion 621*d* and the heat generation portion 622*d* are integrally formed of the same material, and the thickness of the electrode portion 621*d* is larger than the thickness of the heat generation portion 622*d*. Therefore, the heat generation in the electrode portion 621*d* can be suppressed.

Figure 14:
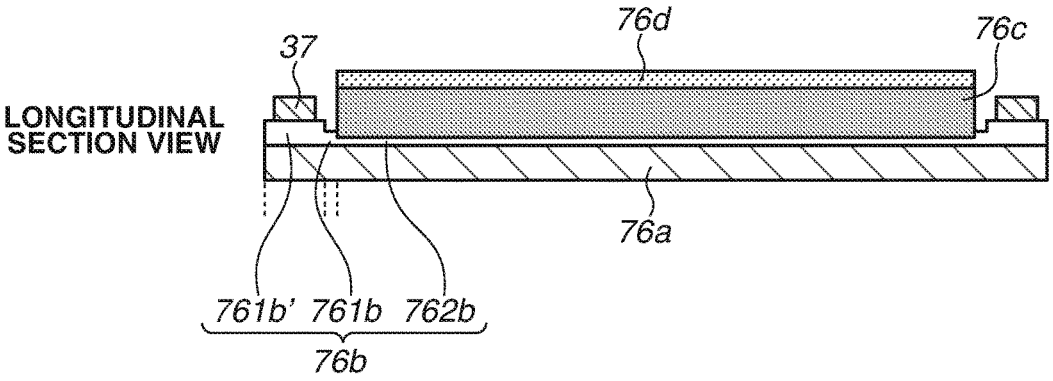
FIG. 14 is a longitudinal section view of a film according to a third example embodiment.

A third example embodiment will be described with reference to FIG. 14. FIG. 14 is a longitudinal section view of a configuration of a film 76.

The present example embodiment is different from the first example embodiment, in that the thickness of an electrode portion is varied.

Operation and configuration similar to those of the first example embodiment may not be described, and a point different from the above-described example embodiments will be mainly described.

As with the first example embodiment, the film 76 includes a base layer 76*a*, a conductive layer 76*b*, an elastic layer 76*c*, and a release layer 76*d*, which are laminated. The conductive layer 76*d* is formed by printing silver ink.

The conductive layer 76*b* is divided into an electrode portion 761*b* and a heat generation portion 762*b* in the longitudinal direction. Of the electrode portion 761*b*, a region in contact with a power feeding member 37 is a feeding member contact portion 761*b*'.

Since the feeding member contact portion 761*b*' is in contact with the power feeding member 37, the feeding member contact portion 761*b*' may wear out and decrease in thickness, as the fixing device 18 is used.

Therefore, in the present example embodiment, a thickness of the electrode portion 761*b* is approximately double the thickness of the heat generation portion 762*b*. In addition, a thickness of the feeding member contact portion 761*b*' is approximately treble the thickness of the heat generation portion 762*b*.

In other words, the thickness of the conductive layer 76*b* in the electrode portion 761*b* is varied, and the thickness of the feeding member contact portion 761*b*' is made larger. Therefore, even if the thickness of the feeding member contact portion 761*b*' decreases, the heat generation in the electrode portion 761*b* can be suppressed.

The entire thickness may be made sufficiently large, without varying the thickness in the electrode portion 761*b*. However, if there is a large thickness variation between parts of the conductive layer 76*b* in the longitudinal direction, a rigidity variation between the parts of the film 76 becomes also large. This may cause damage to the film 76 at an interface between the parts having the thickness variation. The damage to the film 76 can be suppressed by reducing the rigidity variation by providing a step-like thickness variation as in the present example embodiment.

The present example embodiment is described using the example in which the step-like thickness variation is provided in the conductive layer 76*b*. However, the conductive layer 76*b* may have a different thickness variation, such as a slope.

As described above, in the present example embodiment, the thickness of the conductive layer 76*b* in the electrode portion 761*b* is varied, and the thickness of the feeding member contact portion 761*b*' is made larger. Therefore, even if the thickness of the feeding member contact portion 761*b*' decreases, the heat generation in the electrode portion 761*b* can be suppressed.

The first example embodiment to the third example embodiment are described using the silver ink and the nickel plating as the materials of the conductive layer. However, different materials such as other kinds of metal and carbon may be used.

Moreover, in the description of the example embodiments, while the thickness of the conductive layer in the electrode portion is about two to five times larger than that of the heat generation portion, the thickness of the conductive layer in the electrode portion may fall outside this range. However, if the film has flexibility, the thickness of the conductive layer in the electrode portion is desirably increased to about 20 times larger than that of the heat generation portion, in order to suppress damage to the film due to the variation in the thickness of the conductive layer.

The first example embodiment to the third example embodiment are each described using the configuration in which a film is formed to include a conductive layer. The conductive layer includes an electrode portion and a heat generation portion each made of the same material, and the thickness of the conductive layer is larger in the electrode portion than in the heat generation portion This configuration suppresses the heat generation of the electrode portion in the film.

In a fourth example embodiment, there will be described a configuration in which an electrode layer is formed of a material different from that of a heat generation portion, and the electrode layer is formed on the heat generation portion. Operation and configuration similar to those of the first example embodiment may not be described, and a point different from the above-described example embodiments will be mainly described.

Figure 15:
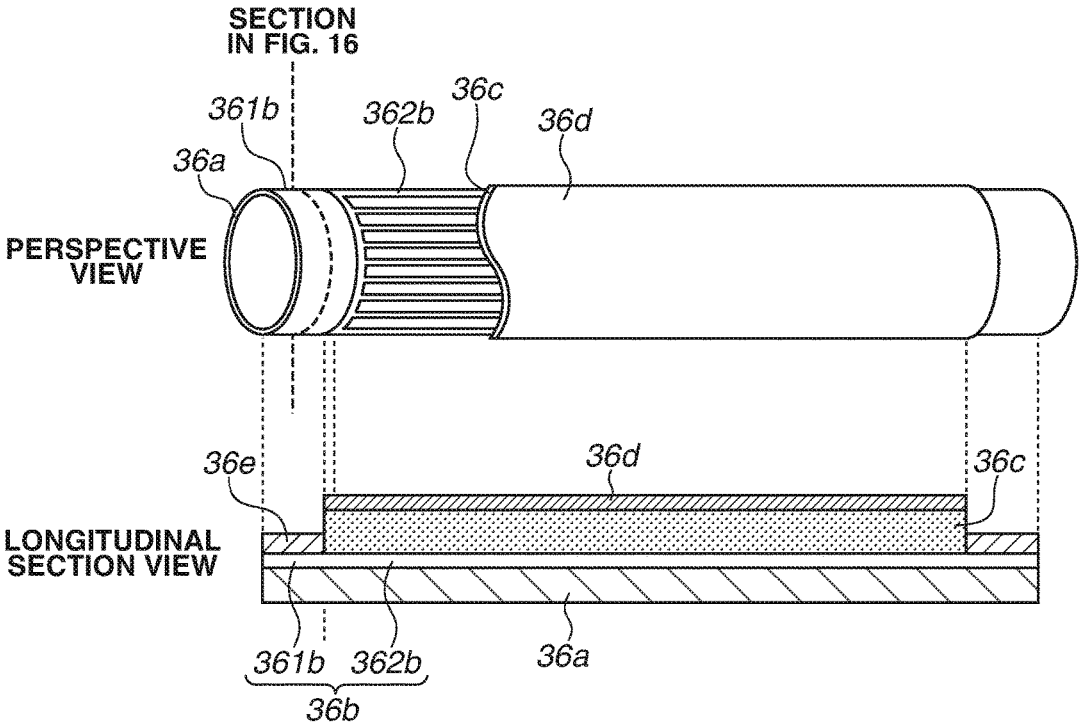
FIG. 15 illustrates a perspective view and a longitudinal section view of a film according to a fourth example embodiment.
Figure 16:
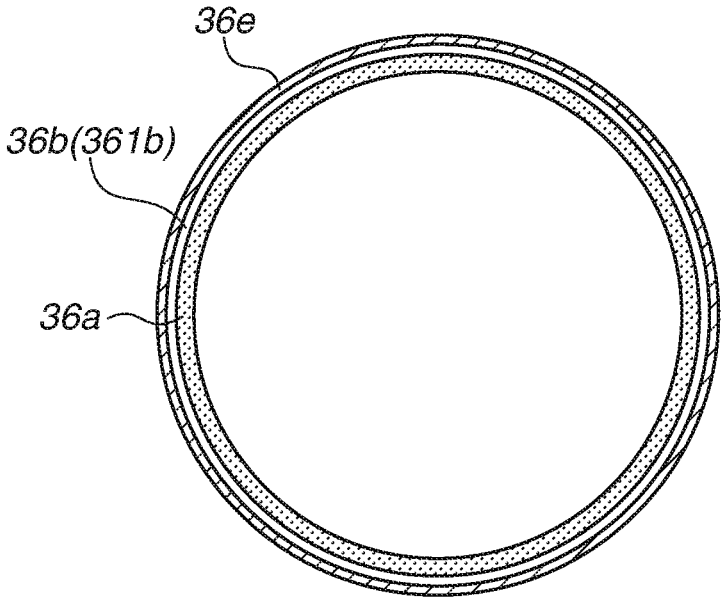
FIG. 16 is a circumferential section view of a layer structure of the film according to the fourth example embodiment.

FIG. 15 is a diagram illustrating a cross section of a film 36 in the longitudinal direction. FIG. 16 is a diagram illustrating a cross section of the film 36 taken along a direction perpendicular to the longitudinal direction of the film 36.

The present example embodiment is different from the first example embodiment as follows. In the present example embodiment, an electrode portion 361*b* and a heat generation portion 362*b* of a conductive layer (a first conductive layer) 36*b* are formed to have the same thickness. In addition, an electrode layer (a second conductive layer) 36*e* made of a material different from that of the conductive layer 36*b* is formed on the electrode portion 361*b*. In the present example embodiment, the electrode portion 361*b* and the heat generation portion 362*b* are made of the same material and integrally form the conductive layer 36*b*, but are not limited to such a configuration.

As illustrated in FIG. 15, the conductive layer 36*b* is divided into thin lines extending in the circumferential direction in the heat generation portion 362*b*, as with the first example embodiment. In contrast, the electrode portion 361*b* is provided at each of both end parts of the film 36 in the longitudinal direction, and has a circular shape extending in the circumferential direction. The electrode portion 361*b* has a thickness of approximately 10 μm, which is substantially equal to that of the heat generation portion 362*b*.

As illustrated in FIG. 16, the electrode layer 36*e* is formed on the conductive layer 36*b* and serves as the uppermost surface layer at each of the end parts of the film 36. In addition, the electrode layer 36*e* is formed by applying silver ink in which a compounding ratio of silver is higher than that in the conductive layer 36*b*. The electrode layer 36*e* has a thickness of approximately 10 μm. Since the compounding ratio of the silver is higher, the electrode layer 36*e* has volume resistivity of 0.2 μΩ·m, which is smaller than 4.2 μΩ19 m that is the volume resistivity of the conductive layer 36*b*. Heat generation of the electrode layer 36*e* can be suppressed by decreasing the volume resistivity of the electrode layer 36*e* to a sufficiently low level.

In addition, since the electrode layer 36*e* is formed on the electrode portion 361*b* having a circular shape, the electrode layer 36*e* has a circumferential surface with less unevenness. The electrode layer 36*e* can therefore secure favorable contactability with the power feeding member 37.

As described above, in the present example embodiment, the electrode layer 36*e* is formed on the electrode portion 361*b* of the conductive layer 36*b*. Therefore, it is possible to secure favorable contactability with the power feeding member 37, while suppressing the heat generation at the end parts of the film 36.

In a fifth example embodiment, there will be described a configuration in which an electrode layer 36*e* is formed up to an inward position in the longitudinal direction from a boundary between an electrode portion 361*b* and a heat generation portion 362*b*. Operation and configuration similar to those of the first example embodiment may not be described, and a point different from the above-described example embodiments will be mainly described.

Figure 17:
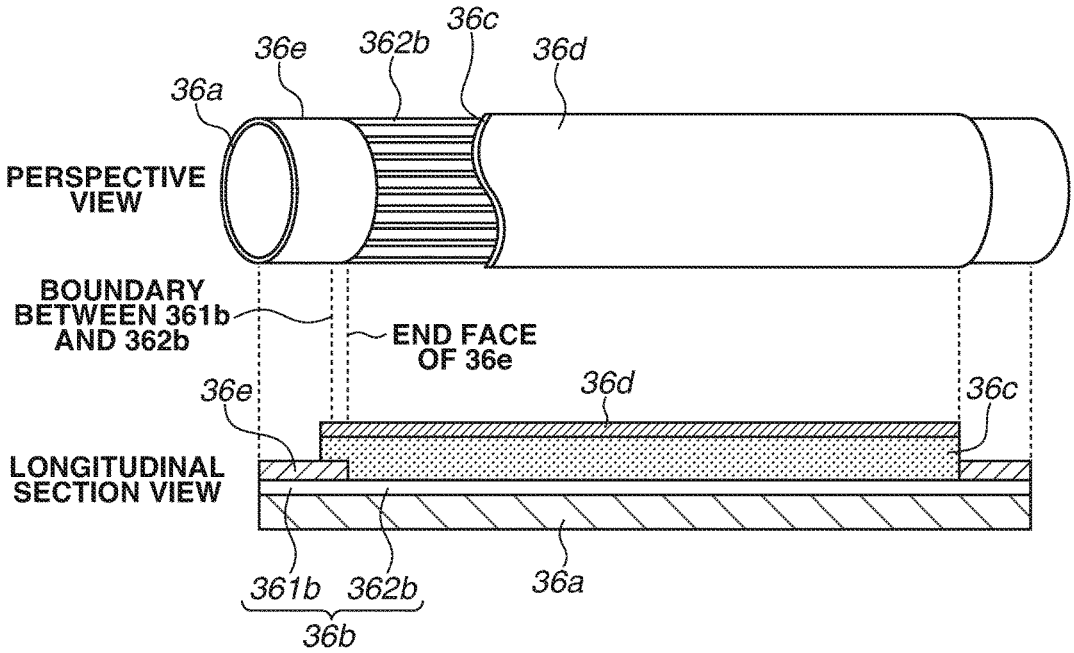
FIG. 17 illustrates a perspective view and a longitudinal section view of a film according to a fifth example embodiment.

FIG. 17 illustrates a configuration of the film 36, specifically, a cross section taken along the longitudinal direction. In the present example embodiment, the electrode layer 36*e* is made of a material different from that of a conductive layer 36*b*. The electrode layer 36*e* is provided not only to be on the electrode portion 361*b* having a circular shape, but also to overlap a part of the heat generation portion 362*b* formed to be thin lines. In other words, the fifth example embodiment is different from the fourth example embodiment, in that the electrode layer 36*e* is formed to overlap the boundary between the heat generation portion 362*b* and the electrode portion 361*b*.

Since the electrode layer 36*e* is formed up to the inward position in the longitudinal direction from the boundary between the electrode portion 361*b* and the heat generation portion 362*b*, an additional effect is produced. The additional affect is to be able to suppress disconnection of the conductive layer 36*b* due to stress applied to the boundary between the electrode portion 361*b* and the heat generation portion 362*b*. However, the heat generation portion 362*b* formed to be thin lines easily becomes uneven in the circumferential direction. Therefore, a region to be in contact with the power feeding member 37 can be provided on the electrode portion 361*b*.

As described above, the present example embodiment produces the additional effect, besides the effect of the fourth example embodiment. The additional effect is to be able to suppress disconnection of the conductive layer 36*b* due to stress applied to the boundary between the electrode portion 361*b* and the heat generation portion 362*b*. In the configuration described in each of the first example embodiment to the third example embodiment, the electrode portion and the heat generation portion are made of the same material, and the thickness of the electrode portion is larger than the thickness of the heat generation portion. In the configuration described in the fourth example embodiment, the electrode portion is formed of the material different from the material of the heat generation portion.

In the method for forming the electrode portion using the same material as the material of the heat generation portion, the electrode portion and the heat generation portion can be integrally formed, and therefore there is such an advantage that a manufacturing process can be simplified. On the other hand, in the method for forming the electrode portion using the material different from the material of the heat generation portion, there is such an advantage that a material suitable for the electrode portion can be freely selected. In addition, it is possible to suppress the heat generation of the electrode portion more effectively, by combining these methods. Further, in each of the fourth and fifth example embodiments, the method for forming the electrode layer is described using the application of the silver ink. However, a different conductive material such as other kinds of metal and carbon may be used, and the method for forming the electrode layer may be a different method such as printing, plating, sputtering, and deposition.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

What is claimed is:

1. A cylindrical film for use in a fixing device, the film comprising:

a base layer having a cylindrical shape;

an electrical conductive layer formed on the base layer and having a cylindrical shape, wherein a volume resistivity of the electrical conductive layer is lower than that of the base layer, wherein the electrical conductive layer includes, a first end part provided at an end of the electrical conductive layer in a longitudinal direction of the film, a second end part provided at an opposite end in relation to the first end part in the longitudinal direction of the film, and a middle part provided between the first end part and the second end part in the longitudinal direction of the film, wherein the middle part includes a plurality of slits arranged in a circumferential direction of the electrical conductive layer, wherein a thickness of each of the first and second end parts is larger than that of the middle part.

2. The film according to claim 1, wherein in the middle part, a ratio of a length of the electrical conductive layer in the longitudinal direction of the film to a length of one round of the base layer in the circumferential direction of the film is 1/10 or more and 3/4 or less.

3. The film according to claim 1, further comprising an elastic layer formed on the middle part.

4. The film according to claim 3, wherein the elastic layer is made of silicone rubber or fluororubber.

5. The film according to claim 4, further comprising a release layer formed on the elastic layer.

6. The film according to claim 5, wherein the release layer is made of fluororesin.

7. The film according to claim 1, wherein the base layer is made of polyimide.

8. The film according to claim 1, wherein the electrical conductive layer is made of silver.

9. A fixing device for fixing a toner image onto a recording material, the fixing device comprising:

(A) a cylindrical film contacting the recording material, the film includes (a) a base layer having a cylindrical shape;

(b) an electrical conductive layer formed on the base layer and having a cylindrical shape, wherein a volume resistivity of the electrical conductive layer is lower than that of the base layer, wherein the electrical conductive layer includes, a first end part provided at an end of the electrical conductive layer in a longitudinal direction of the film, a second end part provided at an opposite end in relation to the first end part in the longitudinal direction of the film, and a middle part provided between the first end part and the second end part in the longitudinal direction of the film, wherein the middle part includes a plurality of slits arranged in a circumferential direction of the electrical conductive layer; and (B) a power supply members being in contact with the first and second end parts of the film, and configured to supply power to the middle part via the first and second end parts, wherein the toner image is fixed onto the recording material by heat of the film, and wherein a thickness of each of the first and second end parts is larger than that of the middle part.

10. The fixing device according to claim 9, further comprising a roller for forming a nip portion where the recording material is conveyed together with the film.

11. The fixing device according to claim 9, wherein in the middle part, a ratio of a length of the electrical conductive layer in the longitudinal direction of the film to a length of one round of the base layer in the circumferential direction of the film is 1/10 or more and 3/4 or less.

12. The fixing device according to claim 9, further comprising an elastic layer formed on the middle part.

13. The fixing device according to claim 12, wherein the elastic layer is made of silicone rubber or fluororubber.

14. The fixing device according to claim 13, further comprising a release layer formed on the elastic layer.

15. The fixing device according to claim 14, wherein the release layer is made of fluororesin.

16. The fixing device according to claim 9, wherein the base layer is made of polyimide.

17. The fixing device according to claim 9, wherein the electrical conductive layer is made of silver.

* * * * *